US011767143B2

(12) United States Patent
Canlas et al.

(10) Patent No.: US 11,767,143 B2
(45) Date of Patent: Sep. 26, 2023

(54) PACKAGE COVERS AND ASSOCIATED ASSEMBLIES AND METHODS

(71) Applicant: Sanford L.P., Atlanta, GA (US)

(72) Inventors: Randel Kert Canlas, Charlotte, NC (US); Timothy James Ruth, Charlotte, NC (US)

(73) Assignee: SANFORD, L.P., Atlanta, GA (US)

( * ) Notice: Subject to any disclaimer, the term of this patent is extended or adjusted under 35 U.S.C. 154(b) by 0 days.

(21) Appl. No.: 17/345,729

(22) Filed: Jun. 11, 2021

(65) Prior Publication Data

US 2021/0387764 A1 Dec. 16, 2021

Related U.S. Application Data

(60) Provisional application No. 63/039,043, filed on Jun. 15, 2020.

(51) Int. Cl.
*B65D 5/42* (2006.01)
*B65D 5/20* (2006.01)

(52) U.S. Cl.
CPC ..... *B65D 5/4233* (2013.01); *B65D 5/2047* (2013.01)

(58) Field of Classification Search
CPC ..... B65D 5/20; B65D 5/2047; B65D 5/38; B65D 5/42; B65D 5/4212; B65D 5/4233; B65D 25/34
USPC ..... 206/459.5, 557–565; 229/67.1, 67.4, 229/87.01, 92.7, 125.12, 125.125
See application file for complete search history.

(56) References Cited

U.S. PATENT DOCUMENTS 1,412,635 A * 4/1922 Ten Eyck ..... B65D 75/04 229/87.01
2,316,362 A * 4/1943 Poe ..... B65D 5/302 229/125.29
2,881,662 A * 4/1959 Harris ..... B60Q 7/005 229/87.01
2,931,559 A * 4/1960 Hilliard ..... B42D 15/08 229/306
4,221,320 A * 9/1980 Faller ..... B65D 5/38 229/125.05
4,444,354 A * 4/1984 Staelgraeve ..... B65D 5/68 206/459.5
4,821,884 A * 4/1989 Griffin ..... B65D 81/343 229/131.1
4,979,667 A * 12/1990 Seaman ..... B65D 85/36 229/125.36
5,711,478 A * 1/1998 Turecek ..... B65D 5/68 229/125.19
5,924,625 A * 7/1999 Klein ..... B65D 5/6685 229/150
D526,893 S * 8/2006 Nixon ..... D9/431
(Continued)

FOREIGN PATENT DOCUMENTS

JP 08282770 A * 10/1996

*Primary Examiner* — Bryon P Gehman
(74) *Attorney, Agent, or Firm* — EVERSHEDS SUTHERLAND (US) LLP

(57) ABSTRACT

Package covers, assemblies, and methods of making the same are provided herein. A package cover is formed of a foldable paperboard blank that has a front panel, a rear panel, a tab extending from the front panel, and a shoulder connecting the front and rear panels, wherein the rear panel defines a notch configured to receive the tab therethrough when the blank is folded into a cover configuration, and wherein the front panel is printed.

20 Claims, 9 Drawing Sheets

(56) References Cited

U.S. PATENT DOCUMENTS

| | | | | |
|---|---|---|---|---|
| 9,120,592 | B2 * | 9/2015 | Kenner | B65D 5/4266 |
| D902,707 | S * | 11/2020 | Postlewait | D9/415 |
| 2009/0288981 | A1 * | 11/2009 | Fedor | B65D 77/044<br>206/459.5 |

* cited by examiner

PACKAGE COVERS AND ASSOCIATED ASSEMBLIES AND METHODS

CROSS-REFERENCE TO RELATED APPLICATIONS

This application claims priority benefit of U.S. Provisional Application No. 63/039,043, filed Jun. 15, 2020, which is incorporated by reference herein in its entirety.

BACKGROUND

Various containers and other methods for packaging and displaying products are known. In retail stores, traditionally, pegs are used to store and display hanging products within aisles. However, such pegs are labor-intensive, as each product must be hung on a peg. Trays and other similar means for displaying products on retail shelves are also known.

Typical retail shelf trays for displaying products include an aisle-facing panel and an opening (e.g., an open top and/or front wall) through which the product may be accessed. The aisle-facing panel may include text or graphics indicative of the product contained in the tray; however, improved means of providing graphics would be desirable.

BRIEF DESCRIPTION OF THE DRAWINGS

The detailed description is set forth with reference to the drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Covers for shelf-ready package (SRP) assemblies (also referred to generally as "trays" herein) have been developed. These covers beneficially may provide premium graphics in a removable and replaceable format for use in conjunction with existing product trays. Thus, the covers may provide a cost-effective secondary package structure that achieve affordable forward-facing panel premium graphics. As used herein, the term "graphics" is meant to encompass any printed text, images, and the like.

Package covers, package assemblies incorporating the package covers, and methods of making and using these package covers are described herein.

Package Covers

Figure 1:
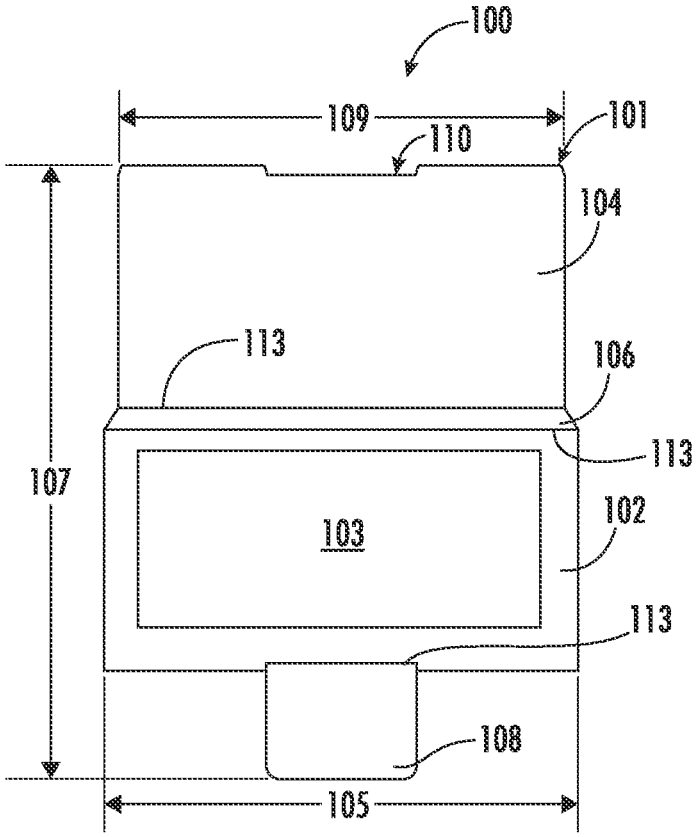
FIG. 1 is a plan view of a package cover blank, in accordance with the present disclosure.
Figure 2A:
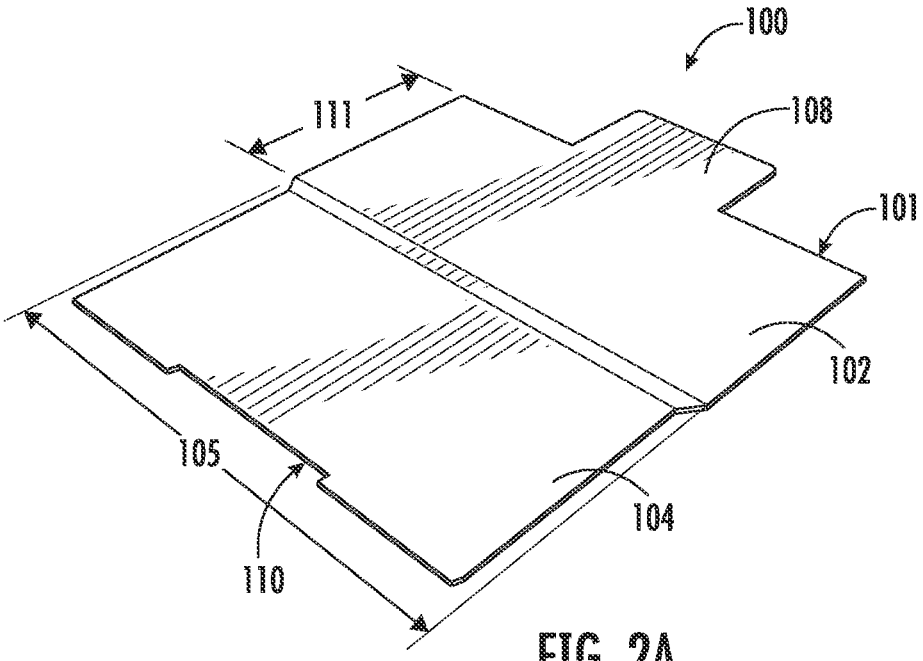
FIG. 2A is a perspective view of a package cover blank, in accordance with the present disclosure.
Figure 2B:
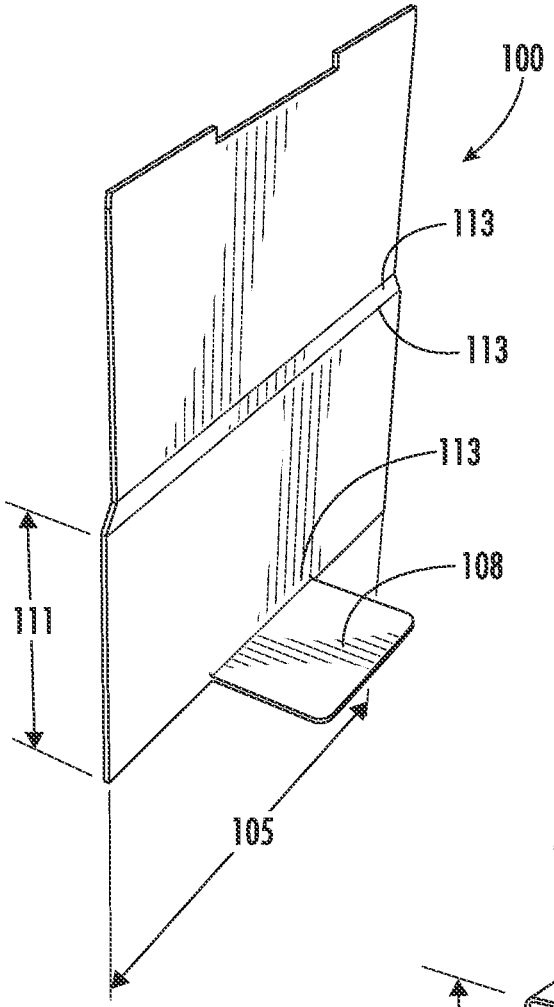
FIG. 2B is a perspective view of the package cover blank of FIG. 2A with its tab folded, in accordance with the present disclosure.
Figure 2C:
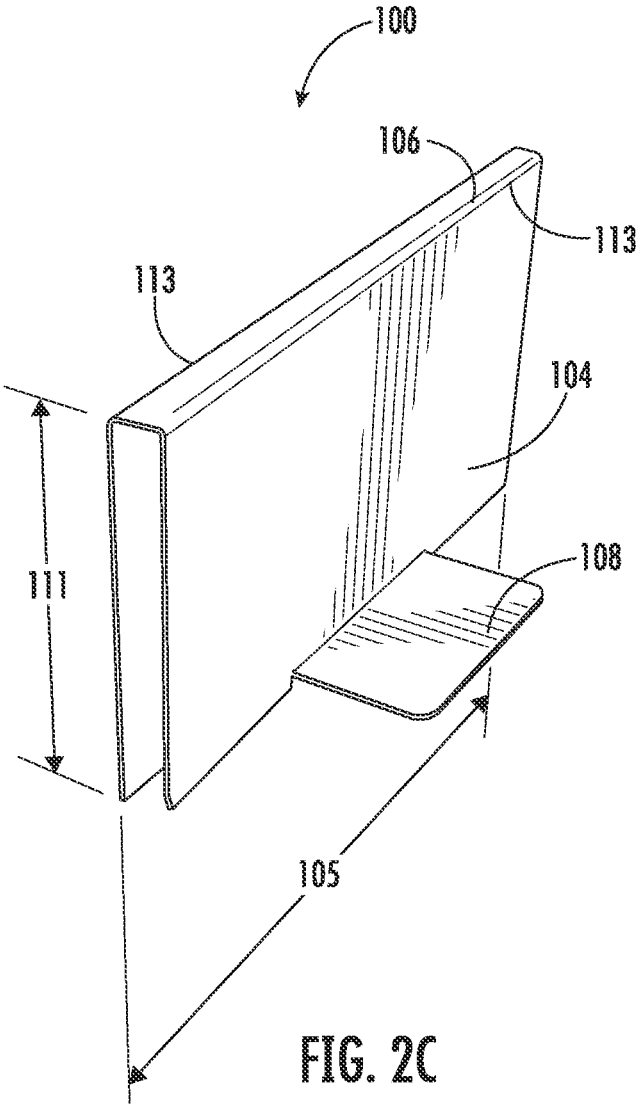
FIG. 2C is a perspective view of the package cover blank of FIG. 2A in a folded cover position, in accordance with the present disclosure.
Figure 2D:
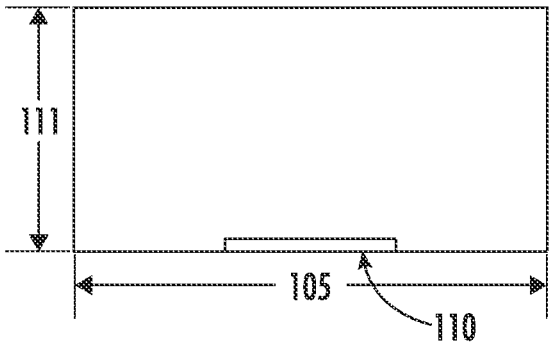
FIG. 2D is a front view of the package cover blank in the folded cover position of FIG. 2C, in accordance with the present disclosure.
Figure 2E:
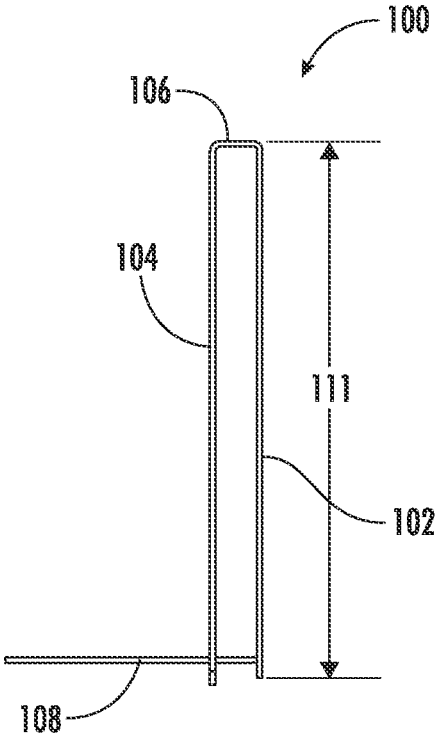
FIG. 2E is a side view of the package cover blank in the folded cover position of FIG. 2C, in accordance with the present disclosure.
Figure 2F:
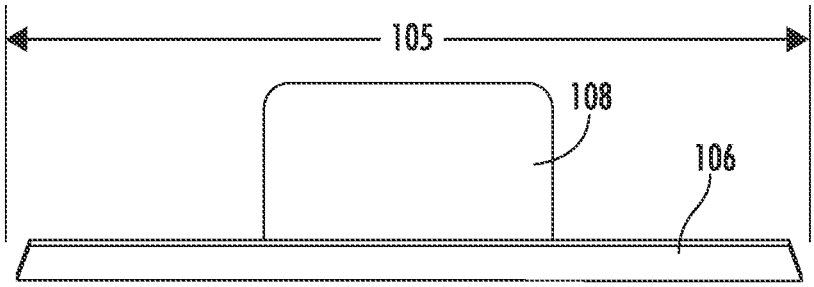
FIG. 2F is an upper view of the package cover blank in the folded cover position of FIG. 2C, in accordance with the present disclosure.
Figure 3:
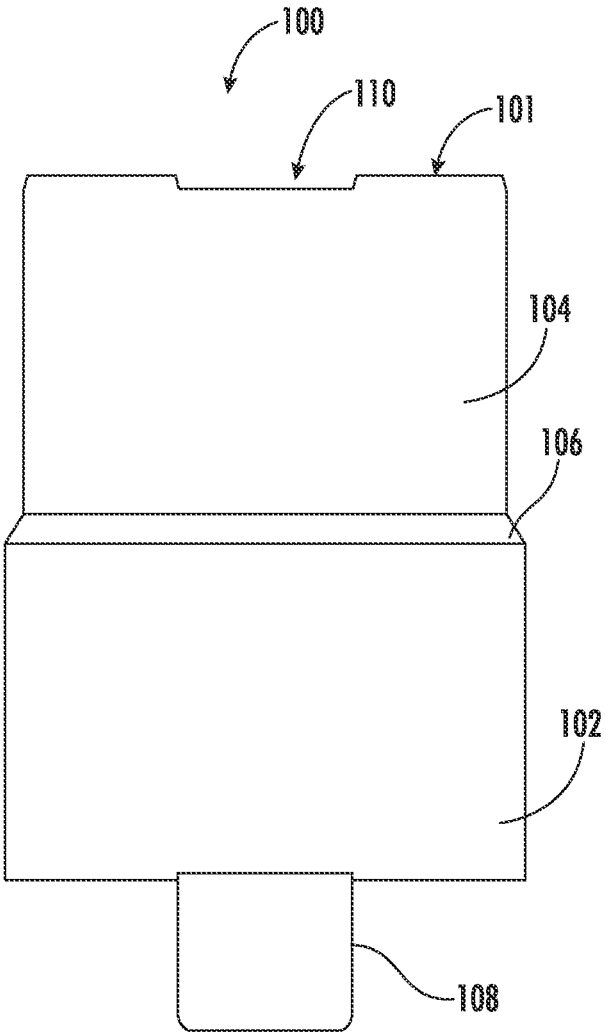
FIG. 3 is a plan view of a package cover blank, in accordance with the present disclosure.

In certain embodiments, as shown in FIGS. 1-3, a package cover 100 is provided. The cover 100 includes a foldable paperboard blank 101 having a front panel 102, a rear panel 104, a tab 108 extending from the front panel 102, and a shoulder 106 connecting the front and rear panels 102, 104. The rear panel 104 defines a notch 110 configured to receive the tab 108 therethrough when the blank 101 is folded into a cover configuration (see FIGS. 2C, 2D, 2E, 2F).

As shown in FIG. 1, the front panel 102 may include printed text and/or graphics, such as at region 103. For example, the printing may include high end or premium inks or graphics that would otherwise be difficult to employ on the tray itself (e.g., due to the tray materials of construction and/or manufacturing methods). Thus, while a tray may have an unprinted or low-end graphic printed front panel, the cover 100 may be printed on its front panel 102, such that when the cover 100 is associated with the tray, the front panel 102 serves as a premium graphic front panel for the tray. As such, improved tray aesthetics may be achieved through use of these covers. Moreover, the configuration of the covers as foldable paperboard blanks allows for simple and non-damaging (to the cover and tray) removal and replacement of the covers.

The foldable blank 101 may be formed of any suitable paperboard. For example, the paperboard may be solid bleached sulfate (SBS), coated kraft or newsback, or a coated recycled paperboard.

As shown in FIG. 1, the blank 101 may have a first length 105, which is the length of the front panel 102. The length of the front panel 102 may be any suitable length, but typically will be identical to or marginally smaller than the corresponding length of the front panel of a tray on which the cover will be deployed. In certain embodiments, the first length is from about 2.5 inches to about 9.5 inches, such as 2.5 inches, 2.8125 inches, 3.25 inches, 3.5625 inches, 3.625 inches, 3.875 inches, 4.125 inches, 4.25 inches, 5.0625 inches, 5.125 inches, 6.125 inches, 6.375 inches, 6.8125 inches, 6.875 inches, 7 inches, 7.125 inches, 8.125 inches, 8.25 inches, 8.4375 inches, 9.125 inches, and any ranges therebetween. As used herein, the term "about" when used with reference to a numerical value, refers to an amount that is plus or minus up to 5 percent of the stated numerical value.

In certain embodiments, the rear panel 104 has a second length 109 that is smaller than the first length of the front panel 102, to accommodate the smaller internal dimension of the tray. For example, the second length may be from about 2 inches to about 9.25 inches.

In embodiments in which the first and second lengths are different, the shoulder 106 may be tapered or otherwise transition between the first and second lengths, such as in a continuous angled or orthogonal configuration.

As shown in FIG. 1, a width, or height, 107, of the blank may be measured from a distal end of the tab 108 to an opposed edge of the rear panel 104. Thus, the height may include the relevant heights of the front and rear panels 102, 104, the tab 108, and the shoulder 106. In certain embodiments, the heights of the front and rear panels 102, 104 are similar to the height of the front panel of a tray on which the cover will be deployed. The height of front panel 102 is illustrated by 111. For example, the heights of the front and rear panels may be equal to the relevant external and internal heights of the front panel of a tray, plus a small material tolerance. For example, for a tray having an external front panel height of about 2 inches, the front and rear panels 102, 104 may have height of about 2 inches (e.g., 2 3/32 inches and 2 1/8 inches, respectively).

The tab 108 may have any suitable height and length for extending through a slot of a relevant tray, and through the notch 110 of the rear panel 104, with enough clearance to be securely retained therein during use. For example, the tab 108 may have a height of from about 0.5 inch to about 2 inches, such as about 1 inch. In certain embodiments, the tab 108 may have a length that is about 1/3 of the length of the front panel of a relevant tray on which the cover will be deployed.

The shoulder 106 may have any suitable height such that the front and rear panels 102, 104 extending therefrom are able to clear the lip of the front panel of the tray and be folded thereover. For example, the should may have a height of from about 1/16 inch to about 1/2 inch, such as about 3/16 inch. In certain embodiments, the shoulder has a height that is about three times the tolerance of the tray wall thickness (i.e., board tolerance).

In certain embodiments, the height of the blank 101, including the heights of the front and rear panels 102, 104, the tab 108, and the shoulder 106, is from about 4 inches to about 10 inches, such as from about 5.5 to about 6.5 inches.

FIG. 3 illustrates one embodiment of a package cover 100, having particular relative dimensions of the component panels.

In certain embodiments, as shown in FIG. 1, the blank 101 includes score lines 113 along which the blank 101 may be folded into an operable cover configuration, for deployment on a tray. For example, the score lines 113 may define opposed edges of the shoulder and/or the base of the tab.

FIGS. 2A-2F illustrate the folding of a blank 101 (FIG. 2A) into an operable cover configuration. FIG. 2B shows the package cover blank of FIG. 2A with its tab 108 folded along score line 113. FIGS. 2C-2F show various views of the package cover blank 101 of FIG. 2A in a folded cover position, with the edges of the shoulder 106 folded along score lines 113 and the tab 108 extending through the notch 110 in the rear panel 104.

Beneficially, it has been found, the package covers of the present disclosure provide an elegant solution to provide upgraded graphics to the front of SRPs for retail applications. The covers offer a removable and replaceable graphical panel, without the need for complex installation or damaging the cover or tray during installation or removal. These covers provide a marked improvement over existing labels used on the front of such trays, such as adhesive labels, which are costly to print, require manual assembly, and are often applied in an off-center or dog-eared placement resulting in a poor aesthetic.

Additionally, due to difficulties with exact application, adhesive labels must be downsized relative to the size of the front panel of the tray on which they are applied. In contrast, the package covers described herein provide for graphic placement that can essentially fill the entire surface area of the front panel of the tray.

Further, the presently described package covers do not require adhesive for secure application to a tray, but can be manually installed simply and precisely.

Additionally, the covers described herein may be easily adapted for use with different tray sizes and configurations.

Assemblies

Package assemblies including the package covers described herein are also provided, along with methods of manufacturing and using such covers.

In certain embodiments, as shown in FIGS. 4-7, a package assembly includes a package tray 200 formed by a plurality of walls (i.e., panels) defining a storage volume 204 therein. The plurality of walls may include a bottom wall 201 and a front wall 203 extending from the bottom wall, the front wall defining an upper lip 202 over which a cover 100 may be folded. The package tray 200 may include a slot 205 extending from an outer surface of the package tray 200 into to the storage volume 204. For example, the slot 205 may extend through the front wall 203 or through an area connecting the front wall 203 and the bottom wall 201.

A cover 100, as described herein, may be folded over the upper lip 202 of the front wall 203 and secured in the cover configuration, such that the printed front panel 102 is disposed at the front wall 203 of the package tray 200. For example, the tab 108 of the cover may be sized and shaped to fit through the slot 205, and the front and rear panels 102, 104 may be sized and shaped to be folded over the upper lip 202 of the front wall 203 and secured in the cover configuration, such that the printed front panel 102 is disposed at the front wall 203 of the package tray 200.

The package tray 200 may have any suitable configuration. For example, the package tray 200 may be a known SRP type tray used in retail applications for displaying and containing products. While illustrations are made herein with reference to SRP containers, it should be understood that this is merely one possible application of the disclosed package covers, and that this design may be incorporated into various other container styles or container accessories.

Figure 6:
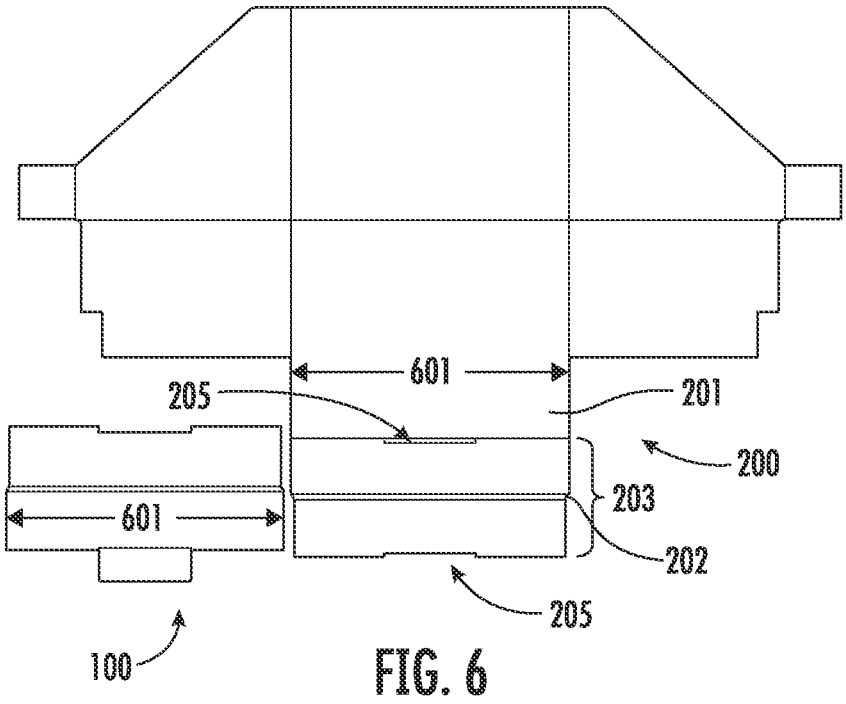
FIG. 6 is a plan view of a tray blank and corresponding package cover blank, in accordance with the present disclosure.
Figure 7:
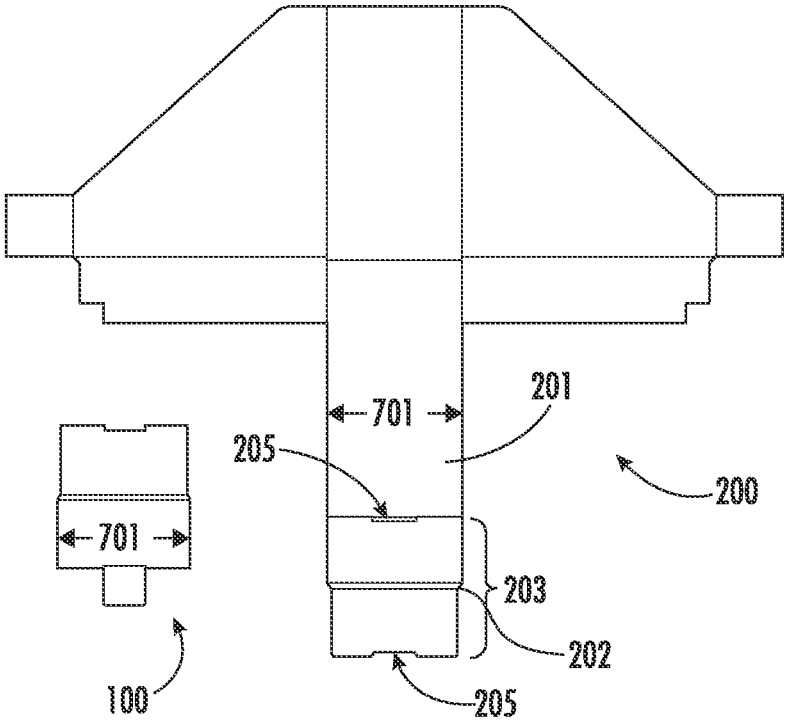
FIG. 7 is a plan view of a tray blank and corresponding package cover blank, in accordance with the present disclosure.

In certain embodiments, as shown in FIGS. 6 and 7, which illustrate tray blanks for suitable package trays 200, the tray is formed from a single folded material sheet, such as a dual-faced (i.e., full) corrugated sheet. As shown in these figures, a tray assembly may be formed from corresponding tray 200 and cover 100 having similar or identical lengths 601, 701. Thus, beneficially, bespoke covers 100 may be manufactured having a similar length to a tray 200 for which a cover is desired.

Figure 4A:
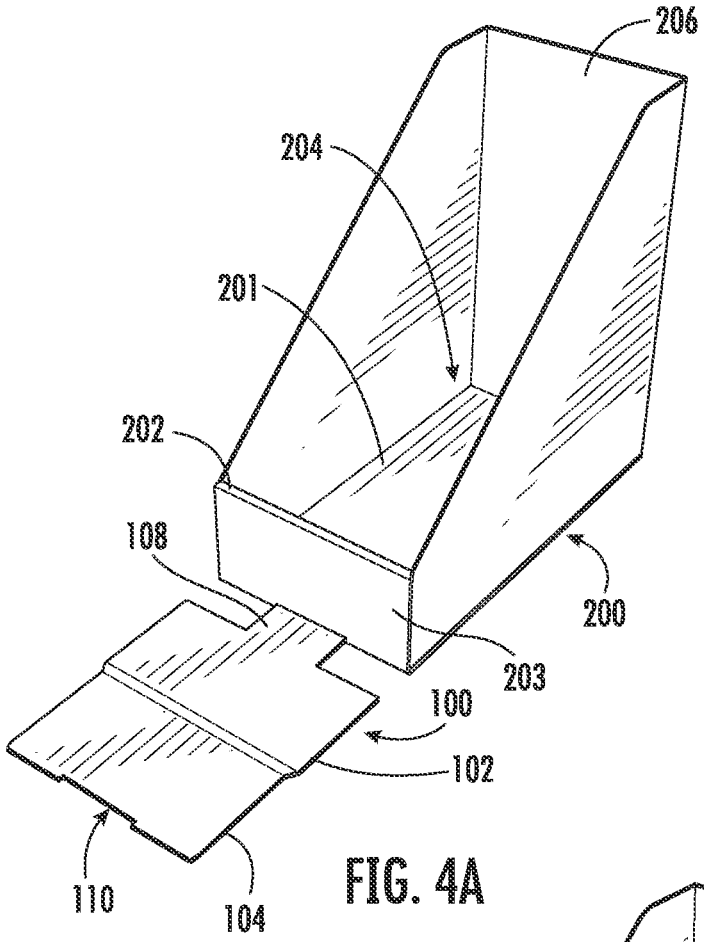
FIG. 4A is a perspective view of a package cover and tray assembly, with the tab of the cover being inserted into the front slot of the tray, in accordance with the present disclosure.
Figure 4B:
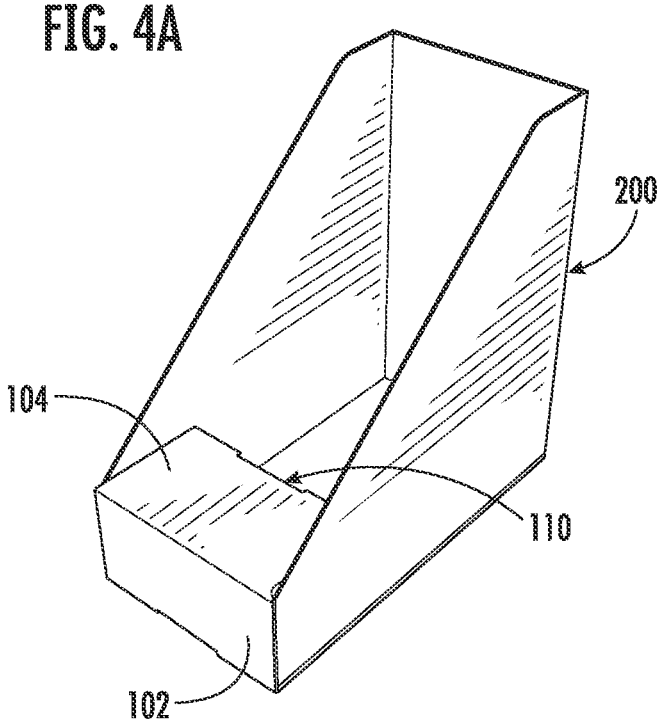
FIG. 4B is a perspective view of the package cover and tray assembly of FIG. 4A, with the cover wrapping around the lip of the tray, in accordance with the present disclosure.
Figure 4C:
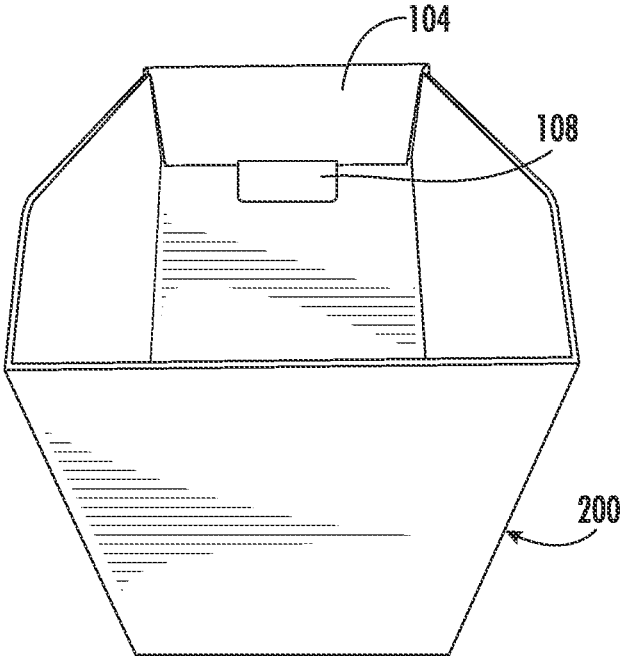
FIG. 4C is a perspective view of the package cover and tray assembly of FIG. 4A, with the cover being positioned in the cover position on the tray, in accordance with the present disclosure.
Figure 4D:
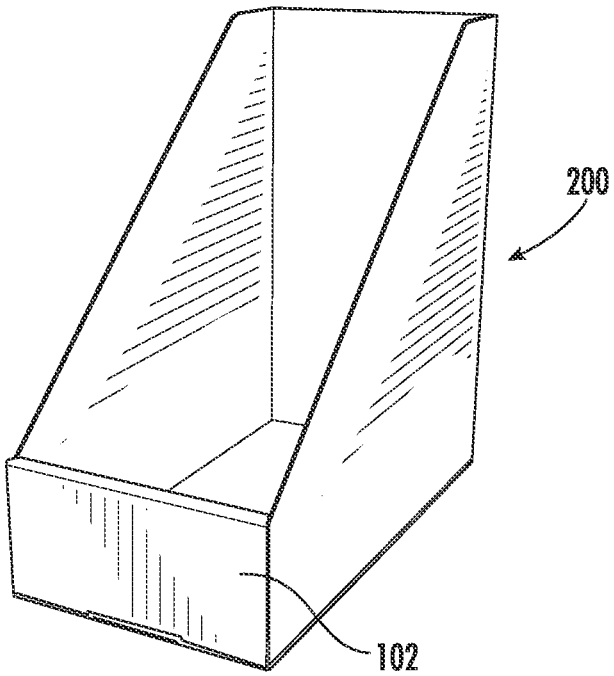
FIG. 4D is a perspective view of the assembled package cover and tray assembly of FIG. 4A, in accordance with the present disclosure.

The blank may be folded up and secured to form a folded tray 200. As shown in FIG. 4A, when folded, the tray 200 includes four sidewalls (e.g., two opposed sidewalls, a front wall 203, and an opposed rear wall 206) extending from a bottom wall 201, with an opening through which product may be displayed and accessed from the storage volume 204.

In certain embodiments, the front wall 203 of the tray has a first height and the rear wall 206 of the tray has a second height that is greater than the first height, such that a front opening for viewing and accessing product contained in the storage volume 204 is provided. For example, in such a configuration, the two opposed side walls may have a tapering height that decreases from the second height to the first height.

The slot 205 of the tray may have any suitable length, such as from about ⅛ to about ⅞ the length of the front wall of the tray, such as about ⅓ a length of the front wall.

Thus, the package assemblies described herein using the package covers 100 on a tray 200 provide an aesthetically improved printed front panel for identifying the contents of the tray. Such assemblies offer an improvement over known packages with low end printed graphics on the tray itself, or with adhesive labels applied to the tray. This reduces the need to print unique items on trays and provides the flexibility to change out the front look of retail trays at a reduced material use.

The cover may be sized and shaped to complement the size and shape of the front panel of the tray. For example, the cover maybe sized and shaped such that the front panel of the cover substantially overlies the front wall of the tray, providing a seamless aesthetic.

Moreover, these assemblies may be constructed without the need for adhesives to secure the cover on the tray.

Methods

Methods of making the package covers described herein are also provided. In certain embodiments, a method includes die cutting a foldable paperboard blank having a front panel, a rear panel, a tab extending from the front panel, and a shoulder connecting the front and rear panels, wherein the rear panel defines a notch configured to receive the tab therethrough when the blank is folded into a cover configuration; and printing a graphic on the front panel.

The printing may occur before or after the die cutting, and may be performed on any suitable printing equipment, including on a printing press. For example, the paperboard may be passed through a print press where inks are laid down and dried and results in the graphics. The method may further include applying a clear coating to the graphic to protect the printed finish.

In certain embodiments, a sheet sized to contain a plurality of blanks (e.g., 25 or more) is run through a press and printed, optionally with a coating, and then die cut to form the blanks.

In some embodiments, the method includes scoring one or more fold lines on the blank, e.g., at the opposed edges of the shoulder and/or at the base of the tab.

Methods of using the package covers described herein are also provided, and illustrated at FIGS. 4 and 5. FIG. 4A illustrates the tab 108 of the cover 100 being positioned for insertion into the front slot 205 of the tray 200. FIG. 4B illustrates the cover 100 wrapping around the lip 202 of the tray 200, to position the front panel 102 and rear panel 104 of the cover on opposite sides of the front wall 202 of the tray 200. FIG. 4C illustrates the cover 100 being positioned in the cover position on the tray 200 with the tab 108 extending through the notch 110 in the rear panel 104. In particular, the cover 100 is secured by friction to the inside of the tray 200, such as via the edge of the rear panel 104 (i.e., flanking the notch 110) being tucked adjacent the bottom wall of the tray 200. FIG. 4D illustrates the assembled package cover and tray assembly.

Figure 5A:
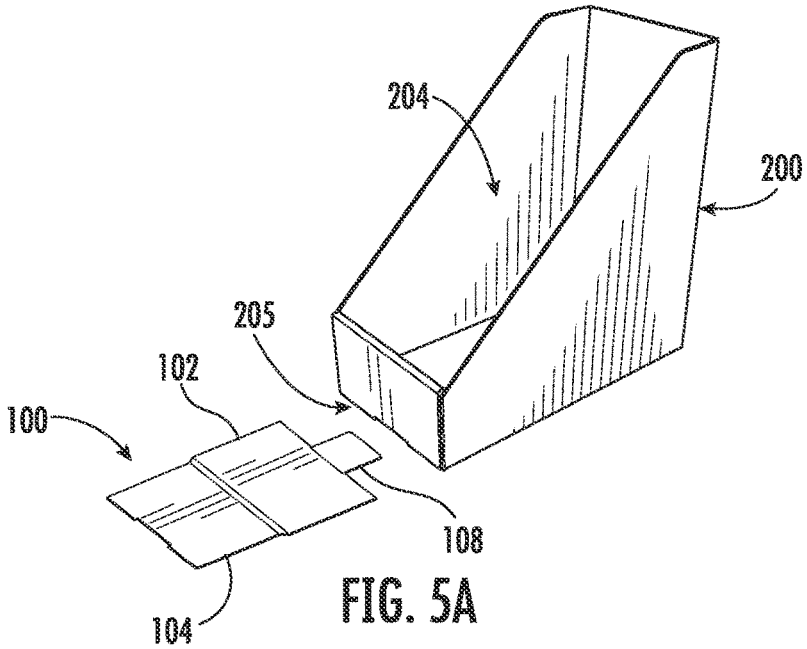
FIG. 5A is a photograph of a package cover and tray assembly, with the tab of the cover being inserted into the front slot of the tray, in accordance with the present disclosure.
Figure 5B:
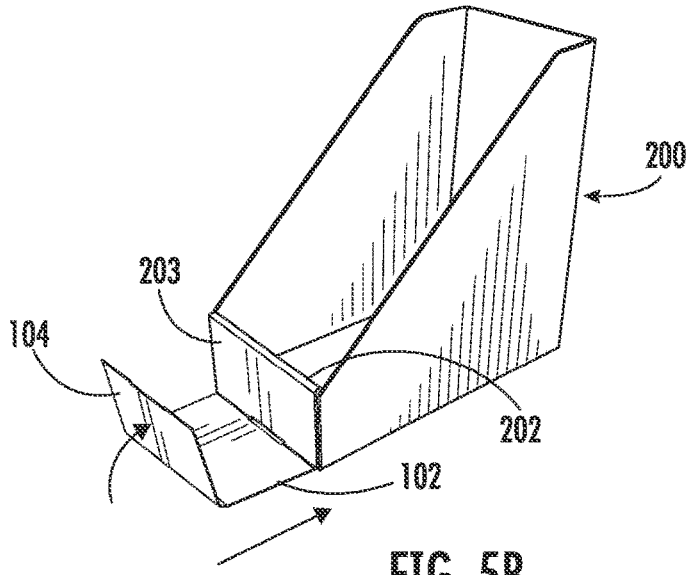
FIG. 5B is a photograph of the package cover and tray assembly of FIG. 5A, with the tab of the cover being inserted into the front slot of the tray, in accordance with the present disclosure.
Figure 5C:
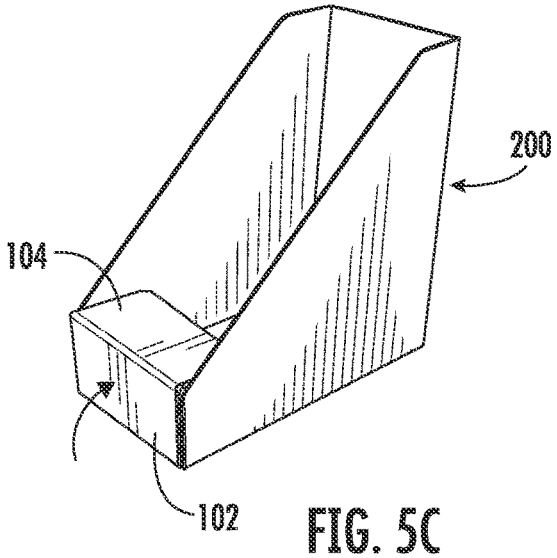
FIG. 5C is photograph of the package cover and tray assembly of FIG. 5A, with the cover wrapping around the lip of the tray, in accordance with the present disclosure.
Figure 5D:
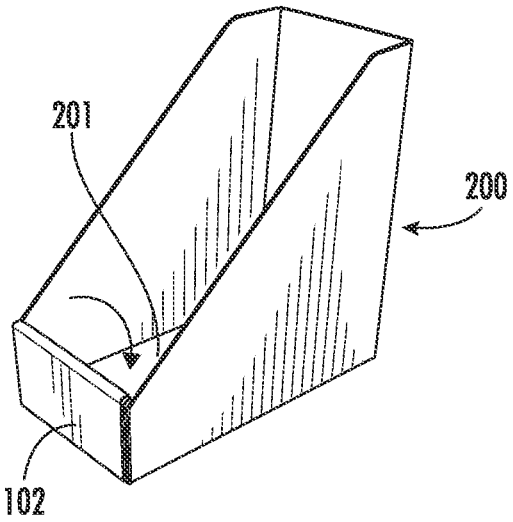
FIG. 5D is a photograph of the package cover and tray assembly of FIG. 5A, with the cover being positioned in the cover position on the tray, in accordance with the present disclosure.
Figure 5E:
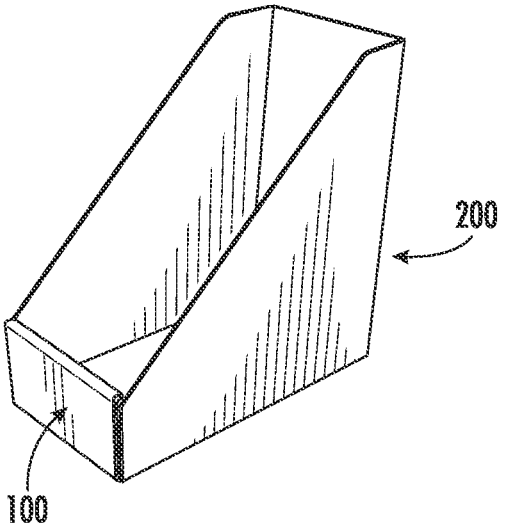
FIG. 5E is a photograph of the assembled package cover and tray assembly of FIG. 5A, in accordance with the present disclosure.

Similarly, FIGS. 5A-5E are show a method of assembly of a cover 100 on a tray 200. FIG. 5A shows the tab 108 of the cover 100 being positioned for insertion into the front slot 205 of the tray 200. FIG. 5B illustrates the tab 108 of the cover 100 being inserted into the front slot 205 of the tray 200 and the rear panel 104 of the cover 100 being raised. FIG. 5C illustrates the cover 100 wrapping around the lip 202 of the tray 200 by raising the front panel 102 to be parallel to one side of the front wall 202 and folding the rear panel 104 to be parallel to the opposite side of the front wall 202. FIG. 5D illustrates the cover 100 being positioned in the cover position on the tray 200, by securing the rear panel 104 at the inner side of the front wall 202 by tucking its edges at the bottom wall 201. FIG. 5E shows the assembled package cover 100 and tray assembly.

Thus, generally, methods of using the cover include folding the cover blank along the score lines to position the tab through the notch of the rear panel. The tab is first slotted through the front of the tray and the panels and shoulder are wrapped around the front lip of the tray. The cover is then friction locked within the tray.

These methods of use provide interchangeable tray display covers that are simple to assemble and install by folding. The covers offer a removable and replaceable graphical panel, without the need for complex installation or damaging the cover or tray during installation or removal. These covers provide a marked improvement over existing labels used on the front of such trays, such as adhesive labels, which are costly to print, require manual assembly, and are often applied in an off-center or dog-eared placement resulting in a poor aesthetic.

While the disclosure has been described with reference to a number of embodiments, it will be understood by those skilled in the art that the invention is not limited to such disclosed embodiments. Rather, the invention can be modified to incorporate any number of variations, alterations, substitutions, or equivalent arrangements not described herein, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A package assembly, comprising:

a package tray comprising a plurality of walls defining a storage volume therein, the plurality of walls comprising a bottom wall and a front wall extending from the bottom wall, the front wall defining an upper lip, wherein the package tray comprises a slot extending from an outer surface of the package tray to the storage volume, the slot extending through the front wall or through an area connecting the front wall and the bottom wall; and a package cover comprising a foldable paperboard blank comprising a printed front panel, a rear panel, a tab extending from the front panel, and a shoulder connecting the front and rear panels, wherein the rear panel defines a notch configured to receive the tab therethrough when the blank is folded into a cover configuration;

wherein the tab is sized and shaped to fit through the slot, and the front and rear panels are sized and shaped to be folded over the upper lip of the front wall and secured in the cover configuration, such that the printed front panel is disposed at the front wall of the package tray.

2. The package assembly of claim 1, wherein the plurality of walls further comprises a rear wall opposite the front wall and two opposed side walls.

3. The package assembly of claim 2, wherein the front wall has a first height and the rear wall has a second height that is greater than the first height.

4. The package assembly of claim 3, wherein the two opposed side walls have a tapering height that decreases from the second height to the first height.

5. The package assembly of claim 1, wherein the plurality of walls are formed of a dual-faced corrugated sheet.

6. The package assembly of claim 1, wherein the slot has a length of about ⅓ a length of the front wall.

7. The package assembly of claim 1, wherein:

the front panel has a first length, and the rear panel has a second length that is shorter than the first length.

8. The package assembly of claim 7, wherein the shoulder is tapered between the first and second lengths.

9. The package assembly of claim 7, wherein the first length is from about 2.5 inches to about 9.5 inches.

10. The package assembly of claim 1, wherein a height of the blank measured from a distal end of the tab to an opposed edge of the rear panel is from about 4 inches to about 10 inches.

11. The package assembly of claim 1, wherein the package cover further comprises score lines defining opposed edges of the shoulder.

12. The package assembly of claim 1, wherein the package cover further comprises a score line at a base of the tab.

13. A package assembly comprising:

a package tray comprising a plurality of walls defining a storage volume therein, the plurality of walls comprising a bottom wall and a front wall extending from the bottom wall, the front wall defining an upper lip, wherein the package tray comprises a slot extending from an outer surface of the package tray to the storage volume, the slot extending through the front wall or through an area connecting the front wall and the bottom wall; and a package cover comprising a foldable paperboard blank comprising a printed front panel, a rear panel, a tab extending from the front panel, and a shoulder connecting the front and rear panels, wherein the rear panel defines a notch configured to receive the tab therethrough when the blank is folded into a cover configuration;

wherein the tab is sized and shaped to fit through the slot.

14. The package assembly of claim 13, wherein the plurality of walls further comprises a rear wall opposite the front wall and two opposed side walls.

15. The package assembly of claim 14, wherein the front wall has a first height and the rear wall has a second height that is greater than the first height.

16. The package assembly of claim 15, wherein the two opposed side walls have a tapering height that decreases from the second height to the first height.

17. The package assembly of claim 13, wherein the plurality of walls are formed of a dual-faced corrugated sheet.

18. The package assembly of claim 13, wherein the slot has a length of about ⅓ a length of the front wall.

19. The package assembly of claim 13, wherein the front and rear panels are sized and shaped to be folded over the upper lip of the front wall and secured in the cover configuration.

20. The package assembly of claim 19, wherein the printed front panel is disposed at the front wall of the package tray.

* * * * *